US007887051B2

(12) United States Patent
Hirokawa et al.

(10) Patent No.: US 7,887,051 B2
(45) Date of Patent: Feb. 15, 2011

(54) STACK ALIGNMENT DEVICE, SHEET DISCHARGE DEVICE AND IMAGE FORMING APPARATUS

(75) Inventors: Ryosuke Hirokawa, Kanagawa (JP); Yasuhiro Sagawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 90 days.

(21) Appl. No.: 12/320,711

(22) Filed: Feb. 3, 2009

(65) Prior Publication Data

US 2009/0200730 A1 Aug. 13, 2009

(30) Foreign Application Priority Data

Feb. 12, 2008 (JP) ..... 2008-031067
Oct. 7, 2008 (JP) ..... 2008-260297

(51) Int. Cl.
*B65H 31/26* (2006.01)

(52) U.S. Cl. ..... 271/220; 271/224

(58) Field of Classification Search ..... 271/220, 271/223, 224; 399/405
See application file for complete search history.

(56) References Cited

U.S. PATENT DOCUMENTS 5,046,717 A * 9/1991 Ettischer et al. ..... 271/219
5,613,672 A * 3/1997 Tanaka et al. ..... 271/162
5,810,348 A * 9/1998 Scheufler ..... 271/213
6,505,830 B2 * 1/2003 Kang ..... 271/223
2002/0017754 A1 * 2/2002 Kang ..... 271/223

FOREIGN PATENT DOCUMENTS

| | | |
|---|---|---|
| JP | 62-197657 | 12/1987 |
| JP | 08-259082 | 10/1996 |
| JP | 09-086755 | 3/1997 |
| JP | 09-208106 | 8/1997 |
| JP | 3373656 | 11/2002 |
| JP | 3744704 | 12/2005 |

OTHER PUBLICATIONS

Abstract of JP 2000-136060 published May 16, 2000.
Abstract of JP 08-020468 published Jan. 23, 1996.

* cited by examiner

*Primary Examiner*—David H Bollinger
(74) *Attorney, Agent, or Firm*—Harness, Dickey & Pierce, P.L.C.

(57) ABSTRACT

A catch tray for stacking sheets discharged from an apparatus that includes a first sheet-stacking area and a second sheet-stacking area. The tray further includes a first stopper regulation part disposed, within the second sheet-stacking area, on a downstream side of the sheet discharging direction that regulates edges of discharged sheets of a largest size allowed to be stacked on the catch tray and a second stopper regulation part in the first sheet-stacking area that regulates edges of the discharged sheets of a size smaller than the largest size and elastically deforms in the sheet discharging direction when a sheet of the largest size is discharged so as to allow the first stopper regulation part to regulate an edge of the sheet of the largest size.

14 Claims, 9 Drawing Sheets

STACK ALIGNMENT DEVICE, SHEET DISCHARGE DEVICE AND IMAGE FORMING APPARATUS

BACKGROUND OF THE INVENTION

1. Field of the Invention

The present invention is directed to the stacking performance of a catch tray of a stack alignment device for stacking recording sheets on which printing has been performed by an image forming apparatus, and also directed to a sheet discharge device and an image forming apparatus that include the stack alignment device.

2. Description of the Related Art

Such image forming apparatuses are used in a variety of ways, and as a result, are generally required to be capable of accommodating the successive use of sheets of different sizes (for example, from A3 size to A6 size). Sheets of different sizes, on which images have been formed inside an image forming apparatus, are discharged from a discharge outlet of the image forming apparatus and then stacked on a catch tray large enough to hold sheets of normal sizes.

As for such a catch tray, the best known structure is that a downwardly inclined tray is provided below the discharge outlet so as to receive sheets discharged from the image forming apparatus. According to this structure, the leading edge of a first discharged sheet is caught by a stopper provided at the lower end of the catch tray and accordingly, the sheet is placed inside the catch tray. However, it is sometimes the case that the rear edge of a sheet is positioned halfway in the tray along the longitudinal direction.

If multiple sheets are stacked in this manner, the leading edge of a subsequently discharged sheet strikes against the rear end of the stacked group of sheets having an increased thickness, or a preceding sheet is pushed out by a succeeding sheet due to surface friction. As a result, a nicely aligned stack of sheets cannot be obtained.

(Patent Document 1) Japanese Laid-open Patent Application Publication No. H09-208106

(Patent Document 2) Japanese Laid-open Patent Application Publication No. H09-086755

(Patent Document 3) Japanese Patent No. 3373656

(Patent Document 4) Japanese Laid-open Patent Application Publication No. H08-259082

(Patent Document 5) Japanese Patent No. 3744704

The present invention aims at providing a catch tray formed in a simple structure at low cost, which catch tray has a stopper made of a wire rod material or another elastic material for catching the leading edges of transfer sheets, causes no sheet jam, and allows transfer sheets of different sizes to be stacked inside.

SUMMARY OF THE INVENTION

In order to resolve the above-mentioned problems, one embodiment of the present invention may be a catch tray for stacking thereon sheets discharged from an apparatus. The catch tray includes a first sheet-stacking area disposed upstream of a sheet discharging direction and having a sloping surface extending upwardly from the upstream side to the downstream side of the sheet discharging direction; a second sheet-stacking area extending from an end of the sloping surface on the downstream side; a first regulation part disposed, within the second sheet-stacking area, on the downstream side of the sheet discharging direction, and configured to regulate edges of the discharged sheets of a largest size allowed to be stacked on the catch tray; and a second regulation part disposed in the first sheet-stacking area, and configured to regulate edges of the discharged sheets of a size smaller than the largest size and elastically deform in the sheet discharging direction when a sheet of the largest size is discharged so as to allow the first regulation part to regulate an edge of the sheet of the largest size.

DETAILED DESCRIPTION OF THE PREFERRED EMBODIMENTS

Embodiments that describe the best mode for carrying out the present invention are explained next with reference to the drawings.

First Embodiment

Figure 1:
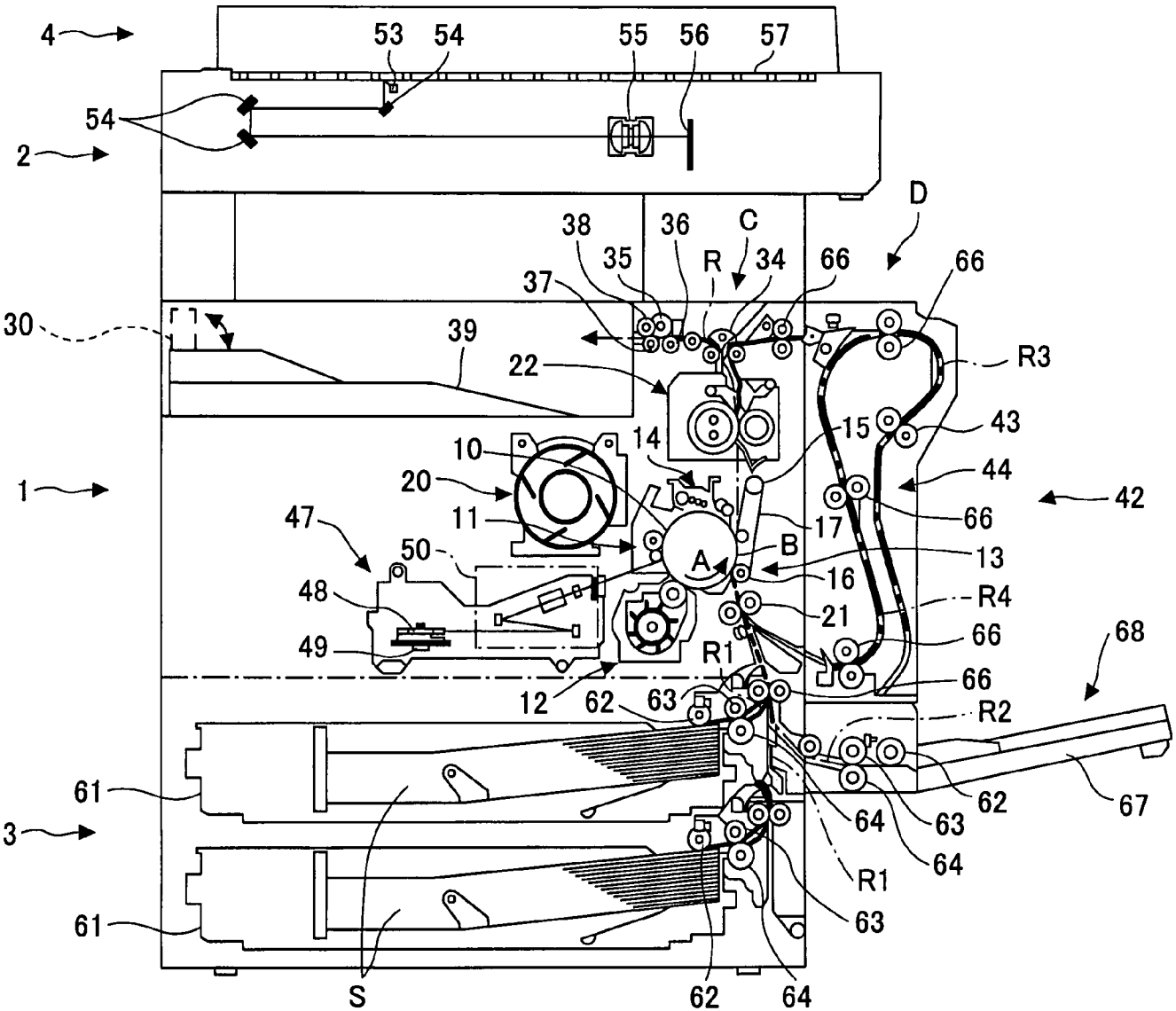
FIG. 1 is a schematic diagram showing an entire structure of an image forming apparatus according to a first embodiment of the present invention.

FIG. 1 is a schematic diagram showing the entire structure of an image forming apparatus according to the first embodiment of the present invention. In FIG. 1, the reference numeral 1 indicates an image forming apparatus main body. The main body 1 has an image reading device 2 on its upper side and a table-like sheet bank 3 on its underside. On the image reading device 2, an automatic document feeder 4 is provided in an openable and closable manner.

The main body 1 includes a drum-shaped photoreceptor 10 which functions as an image carrier. Around the photoreceptor 10, a charging device 11 (left-hand side of the photoreceptor 10 in FIG. 1), a developing device 12 (lower side), a transfer device 13 (right-hand side) and a cleaning device 14 (upper side) are disposed sequentially in the rotational direction A (counterclockwise direction) of the photoreceptor 10. In the transfer device 13, a transfer belt 17 is wound around an upper roller 15 and a lower roller 16. The transfer belt 17 is pressed against the circumference of the photoreceptor 10 at a transferring site B.

In FIG. 1, a toner supply device 20 for supplying new toner to the developing device 12 is provided on the left-hand side of the charging device 11 and the cleaning device 14. Inside the main body 1, a sheet conveying device C is provided for sending out a sheet, such as paper or an OHP sheet, from a supplying site and conveying the sheet to a stacking site via the transferring site B. The sheet conveying device C includes a supply pathway R1, a manual feeding supply pathway R2 and a sheet conveying pathway R to be described below. The sheet conveying pathway R extends in a substantially L-shaped fashion, going through between the photoreceptor 10 and the transfer device 13, extending upward and then curving toward the left-hand side of FIG. 1.

In the sheet conveying pathway R, resist rollers 21 are provided upstream of the photoreceptor 10, and a fixing device 22 is provided downstream of the photoreceptor 10. The fixing device 22 includes a pair of fixing rollers (fixing roller rotation bodies). A fixing heater is provided inside a first roller of the fixing rollers. A pressurizing spring, a pressurizing arm and the like are provided around a second fixing roller. Using the pressurizing spring and pressurizing arm, the second fixing roller is pressed against the right-hand side of the first fixing roller. In addition, a thermistor and a thermostat are provided in the first fixing roller. The temperature of the paired fixing rollers is measured by the thermistor, and the fixing heater is switched on and off by the thermostat so as to maintain the fixing rollers at a predetermined temperature.

Further downstream of the fixing device 22, a discharge branching claw 34, a discharge roller 35, a first pressurizing roller 36, a second pressurizing roller 37 and a sheet deflection roller 38 are provided. Then, further on the left-hand side in FIG. 1, a discharge stack unit (discharge site) 39 is provided for stacking sheets having images formed on their surfaces. On the front side or left-hand side (the downstream end in the discharging direction) of the main body 1, an open section is provided so that the stacked sheets in the discharge stack unit 39 can be taken out. In order to prevent the sheets from falling out of the open section, an end stopper 30 is provided in the discharge stack unit 39 at the downstream end in the discharging direction so that sheets having a maximum length allowed to be laid in the discharge stack unit 39 hit the end stopper 30. The end stopper 30 can be housed inside the discharge stack unit 39, or can be rotated and raised as indicated by the arrow in FIG. 1. A regulating member is provided so as to prevent the end stopper 30 being raised from rotating and moving in the sheet discharging direction.

In the main body 1, a switch-back device 42 is provided on the right-hand side in FIG. 1. The switch-back device 42 includes a sheet conveying device D having a reverse pathway R3 and a re-conveying pathway R4. The reverse pathway R3 starts from the point of branching off by the discharge branching claw 34 and extends to the switch-back site 44 provided with a pair of switch-back rollers 43. The re-conveying pathway R4 starts from the switch-back site 44 and extends to the resist rollers 21 of the sheet conveying pathway R. The sheet conveying device D includes multiple sheet conveying rollers 66 (sheet conveying rotation bodies) for conveying sheets.

On the left-hand side of the developing device 12 in FIG. 1, a laser writing device 47 is provided. The laser writing device 47 includes a laser light source (not shown), a scanning rotating polygon mirror 48, a polygon motor 49, a scanning optical system 50, such as an fθ lens, and the like. The image reading device 2 includes a light source 53, multiple mirrors 54, an optical lens for image formation 55, an image sensor 56, such as a CCD, and the like. In addition, a contact glass 57 is provided on the top surface of the image reading device.

The automatic document feeder 4 disposed on the contact glass 57 includes a loading stage (not shown) at a location for loading originals and a discharge stage (not shown) at a discharging location. The automatic document feeder 4 also includes a sheet conveying device having an original conveying pathway (not shown) in which sheets, e.g. originals, are conveyed from the loading stage to a reading site on the contact glass 57 of the image reading device 2, and subsequently to the discharge stage. The sheet conveying device includes multiple sheet conveying rollers (sheet conveying rotation bodies) (not shown) for conveying sheets, e.g. originals.

The sheet bank 3 includes multi-tier sheet cassettes 61 which are a supplying site of sheets S. Each sheet cassette 61 includes a fetch roller 62 (feeding roller), a supply roller 63 (feeding roller) and a separating roller 64 (feeding roller). On the right-hand side of the multi-tier sheet cassettes 61 in FIG. 1, the supply pathway R1 connected to the sheet conveying pathway R of the main body 1 is formed. The supply pathway R1 includes the sheet conveying rollers 66 (sheet conveying rotation bodies) for conveying sheets.

The main body 1 includes a manual feeding supply unit 68 on the right-hand side in FIG. 1. In the manual supply unit 68, a manual feeding tray 67 (supply site) is provided openably and closably. The manual supply unit 68 also includes the manual feeding supply pathway R2 for conveying manual sheets set on the manual feeding tray 67 to the sheet conveying pathway R. Like the sheet cassettes 61, the manual feeding tray 67 also includes the fetch roller 62 (feeding roller), the supply roller 63 (feeding roller) and the separating roller 64 (feeding roller).

In order to make a copy using a copying function, a main switch (not shown) is switched on, and an original is set on the automatic document feeder 4. Alternatively, the automatic document feeder 4 is lifted, and the original is set on the contact glass 57 of the image reading device 2. Then, the automatic document feeder 4 is closed, thereby holding the original in place.

In the case of setting the original on the automatic document feeder 4, when a start switch (not shown) is pressed, the original is transported, through the original conveying pathway by the sheet conveying rollers, onto the contact glass 57. Subsequently, the image reading device 2 is driven to read the original, which is then discharged to the discharge stage. On the other hand, in the case of setting the original directly on the contact glass 57, the image reading device 2 is immediately driven.

When driven, the image reading device 2 moves the light source 53 along the contact glass 57. At the same time, light emitted from the light source 53 is reflected on the surface of the original on the contact glass 57. The reflected light is then reflected into the image sensor 56 by the multiple mirrors 54 via the image-formation optical lens 55, and the image sensor 56 reads the original.

Simultaneously, the photoreceptor 10 is rotated by a photoreceptor drive motor (not shown) During the rotation, the photoreceptor is uniformly charged by the charging device 11. Then, the laser writing device 47 emits laser light corresponding to an image of the original read by the image reading device 2 to form a latent image on the surface of the photoreceptor 10. The developing device 12 subsequently develops the latent image into a visible image using toner.

At the same time when the start switch is pressed, the sheets S are sequentially sent out by the fetch roller 62 from an appropriate sheet cassette 61 of the multi-tier sheet cassettes 61 in the sheet bank 3. The sheets S are conveyed by the supply roller 63 while separated from one another by the separating roller 64, and sent one by one to the supply pathway R1. Each sheet S is conveyed by the sheet conveying rollers to the sheet conveying pathway R, and then stopped when hitting the resist rollers 21. Subsequently, the resist rollers 21 rotate at a timing according to the rotation of the visible image on the photoreceptor 10, so as to send the sheet S to the right-hand side of the photoreceptor 10.

Alternatively, the manual feeding tray 67 of the manual feeding supply unit 68 is unfolded, and sheets set in the manual feeding tray 67 are sent out by the fetch roller 62. The sheets are conveyed by the supply roller 63 while separated from one another by the separating roller 64, and sent one by one to the manual feeding supply pathway R2. Each sheet is conveyed by the sheet conveying rollers 66 to the sheet conveying pathway R. Then, the resist rollers 21 rotates at a timing according to the rotation of the photoreceptor 10, so as to send the sheet to the right-hand side of the photoreceptor 10.

Next, the transfer device 13 having the transfer belt 17 transfers the image on the photoreceptor 10 at the transferring site B to a sheet S sent to the right-hand side of the photoreceptor 10, thereby forming an image on the sheet S. Remaining toner not transferred and left on the photoreceptor 10 is removed and cleaned by the cleaning device 14. Then, a remaining potential on the photoreceptor 10 is removed by a neutralization device (not shown) to make the photoreceptor 10 ready for the next image formation starting again at the charging device 11.

On the other hand, the sheet S to which an image has been transferred is conveyed by the transfer belt 17, and passed through between paired fixing rollers 24*a* and 24*b* of the fixing device 22, which apply heat and pressure to fix the transferred image onto the sheet S. Subsequently, the sheet S is then deflected by the discharge roller 35, first pressurizing roller 36, second pressurizing roller 37 and sheet deflection roller 38, and ejected to the discharge stack unit 39.

In the case where images are transferred to both sides of the sheet, the discharge branching claw 34 is switched. A sheet to one side of which an image has been transferred is introduced from the sheet conveying pathway R to the reverse pathway R3. The sheet is conveyed by the sheet conveying rollers 66 to the switch-back site 44, at which the sheet is switched back and reversed in the re-conveying pathway R4. The sheet is then conveyed by the sheet conveying roller 66 to the sheet conveying pathway R, and an image is then transferred to the other side of the sheet in the same manner as described above.

Figure 2:
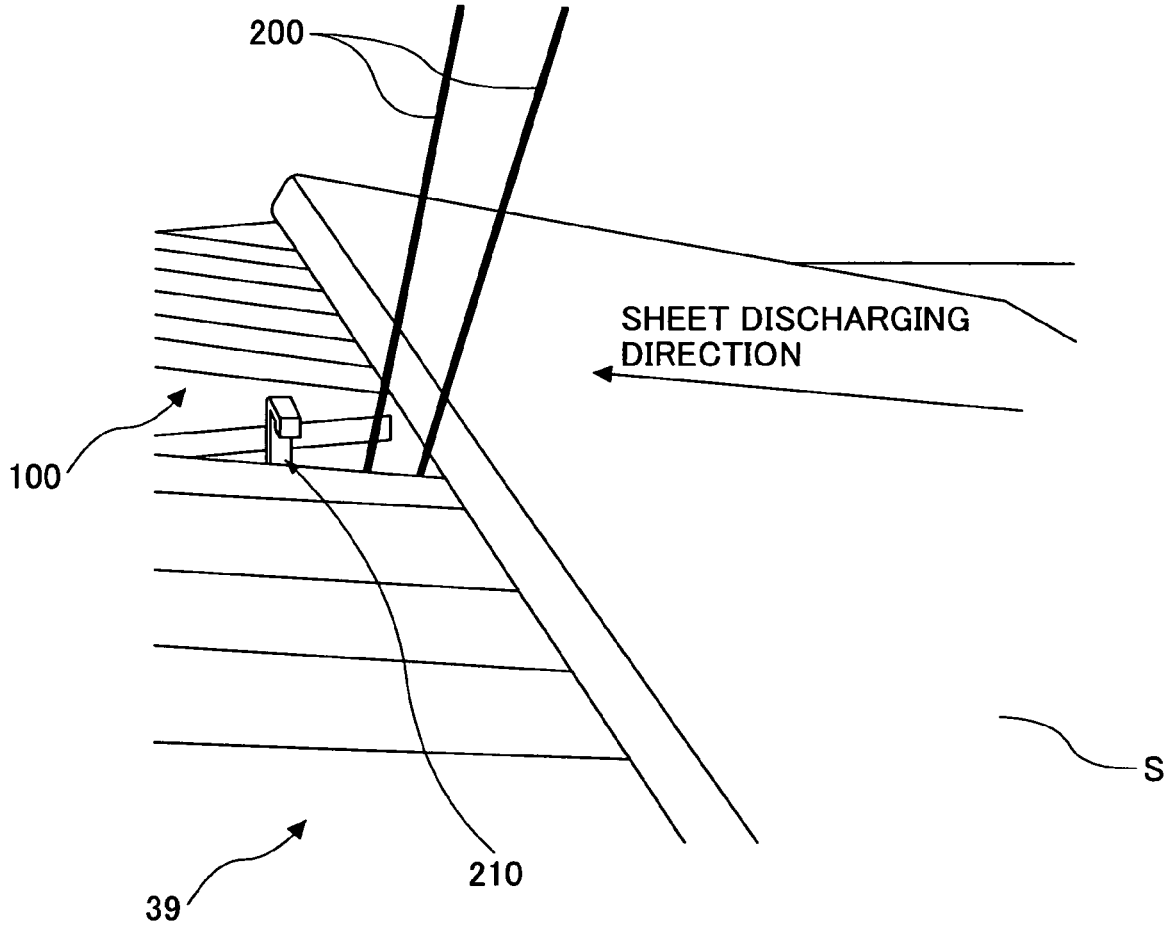
FIG. 2 illustrates operation of a spring stopper of the first embodiment of the present invention.

FIG. 2 illustrates a spring stopper 200 according to the present embodiment. The spring stopper 200 is provided in such a manner that one end of the spring stopper 200 is secured in a depression 100 on the slope of the discharge stack unit 39 and the other end, formed as a free end, protrudes from the sheet stacking surface of the discharge stack unit 39. FIG. 2 shows that the leading edges of the sheets S of A4 size discharged sideways by the discharge roller 35, first pressurizing roller 36, second pressurizing roller 37 and sheet deflection roller 38 are blocked by the spring stopper 200 attached to the discharge stack unit 39 serving as a catch tray. In this way, the stack alignment of the sheets is improved ("S" in FIG. 2 indicates multiple stacked sheets).

That is, even if a preceding sheet is pushed out by a succeeding sheet due to surface friction of these sheets, the pushed-out preceding sheet is bounced back toward the upstream side of the sheet discharging direction due to the elasticity of the spring stopper 200. Thus, since a pushed-out sheet is returned to the upstream side of the sheet discharging direction along the sloping surface of the discharge stack unit 39 in such a manner, no sheets are positioned halfway in the discharge stack unit 39. As a result, a nicely aligned stack of sheets can be obtained. In order to prevent the stopping force of the spring stopper 200 from being overwhelmed by the sheet conveyance force, the diameter of the wire rod of the spring stopper 200 is preferably Φ0.1 mm to Φ1.0 mm. In an example of FIG. 2, the diameter of the wire rod is Φ0.6 mm. Since being provided for improving the stack alignment of the sheets S, the spring stopper 200 is positioned in the downstream side of a point in the discharge stack unit 39, the point of which is located a sheet length away from paired discharging rollers 201. In addition, since being made of a wire rod material, the spring stopper 200 is capable of improving the stack alignment of the sheets S without damaging the leading edges of the sheets S, thereby improving the discharge stack performance. Furthermore, even if the user catches his/her hand on the spring stopper 200 when he/she picks up the sheets S from the catch tray or the discharge stack unit 39, the spring stopper 200 made of a wire rod material freely bends, thereby ensuring safety.

Figure 3A:
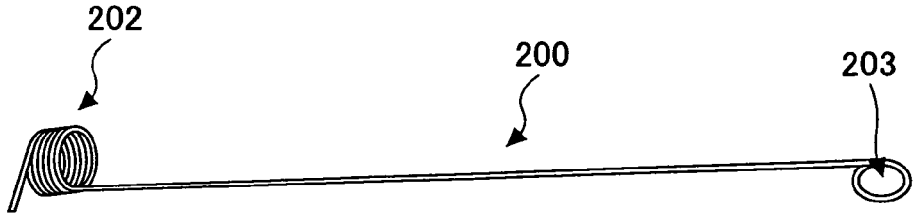
FIG. 3A is an overall view of the spring stopper.
Figure 3B:
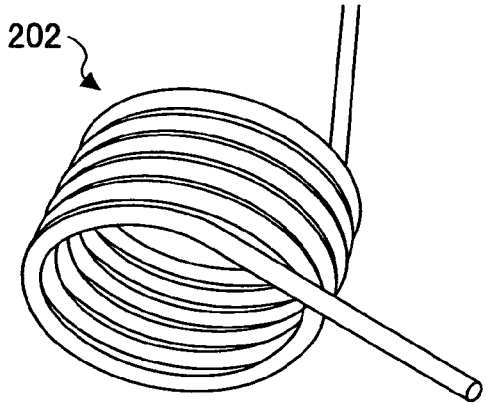
FIG. 3B is an enlarged view of a rear anchor part of the spring stopper.
Figure 3C:
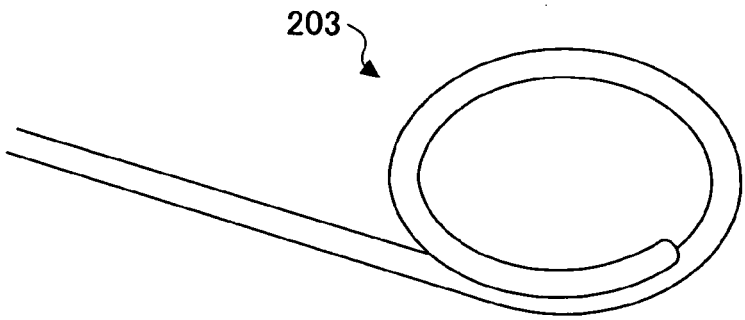
FIG. 3C is an enlarged view of a tip part of the spring stopper.

FIG. 3A is an overall view of the spring stopper 200; FIG. 3B is an enlarged view of a rear anchor part of the spring stopper 200; and FIG. 3C is an enlarged view of a tip part of the spring stopper 200. In the wire-rod rear anchor part to be attached to the discharge stack unit 39, a mounting coil portion 202 is formed by winding the wire rod several turns into a coil spring, as shown in FIGS. 3A and 3B. Of the wire rod which functions as a stopper part, the tip part includes a tight loop portion 203. By providing the coil spring (mounting coil portion 202), it is possible to readily adjust the stopping force of the spring stopper 200. Also, by making the tip part round by looping the wire rod, it is possible to prevent the user from getting hurt when he/she picks up sheets from the discharge stack unit 39. Furthermore, since the loop is tightly formed, it is possible to prevent several springs from getting tangled with one another during parts assembly and the like, thereby improving the assembly performance.

Second Embodiment

Figure 4:
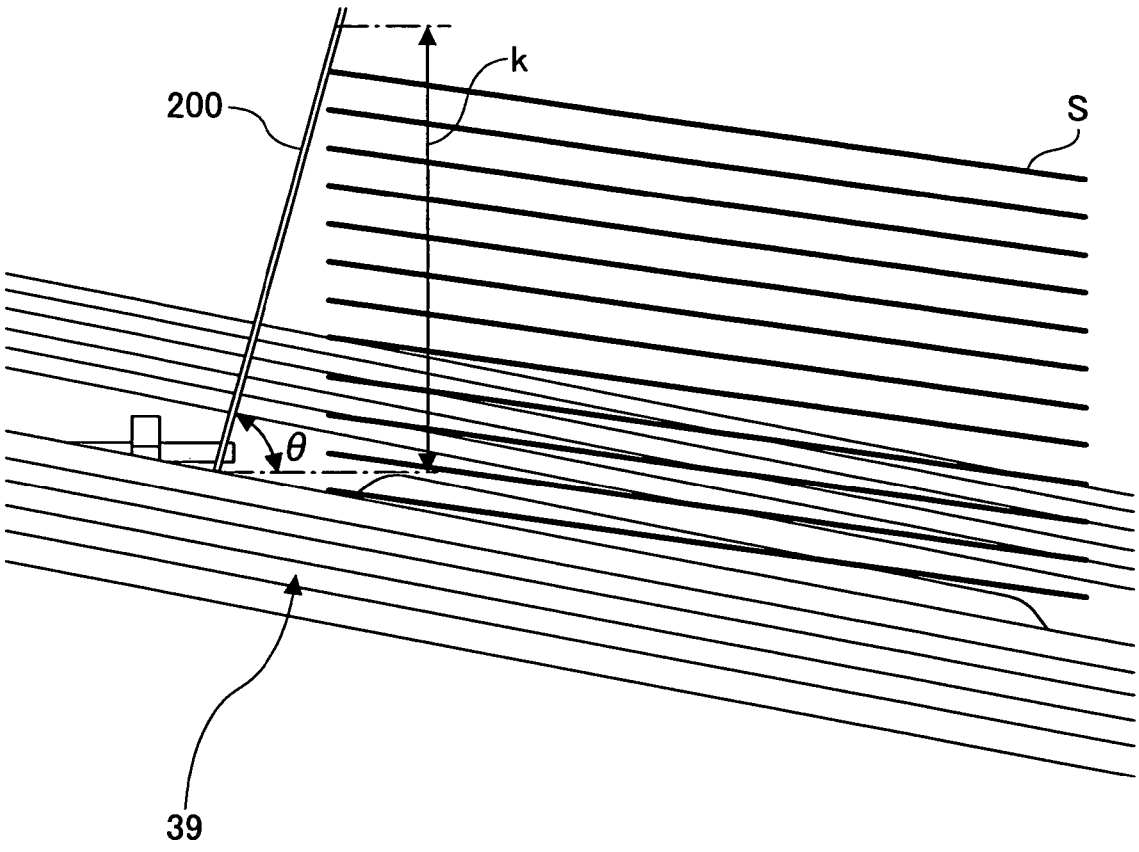
FIG. 4 is a diagram illustrating the second embodiment of the present invention.

Next is described the second embodiment of the present invention with reference to FIG. 4. According to the present embodiment, two spring stoppers 200 are provided substantially parallel to the main scanning direction of the sheet S (substantially perpendicular to the sheet surface in FIG. 4). Note that, since FIG. 4 shows a view seen from a direction along the main scanning direction, it appears that only one spring stopper 200 is provided. The length of the stopper part of each spring stopper 200 is preferably 5 mm to 100 mm (appropriate length may be determined in such a manner as to accommodate sheets of various different sizes and improve the stack alignment of the sheets). Each spring stopper 200 is inclined at an angle between 45° and 90° in the reverse direction of the sheets S being discharged. By inclining the spring stoppers 200, the sheets S can be stacked along the slope of the upper surface of the discharge stack unit 39, thereby improving the discharge stack performance. Note that, in the example of FIG. 4, an inclination angle θ of each spring stopper 200 is 75° in the reverse direction of the sheets S being discharged, and a length of the stopper part k is 55 mm. Using this structure of FIG. 4 in an experiment associated with the present invention, it was found possible to significantly improve the stack alignment when 500 sheets were stacked together. That is to say, by providing multiple spring stoppers 200 parallel to a direction substantially perpendicular to the sheet conveying direction, it is possible to prevent the spring stoppers 200 from moving and rotating when a sheet S hits the spring stoppers 200. Furthermore, even a sheet S discharged in a skewed manner can be aligned properly, thus improving the discharge stack performance and further improving the stack alignment of sheets.

Third Embodiment

Figure 5:
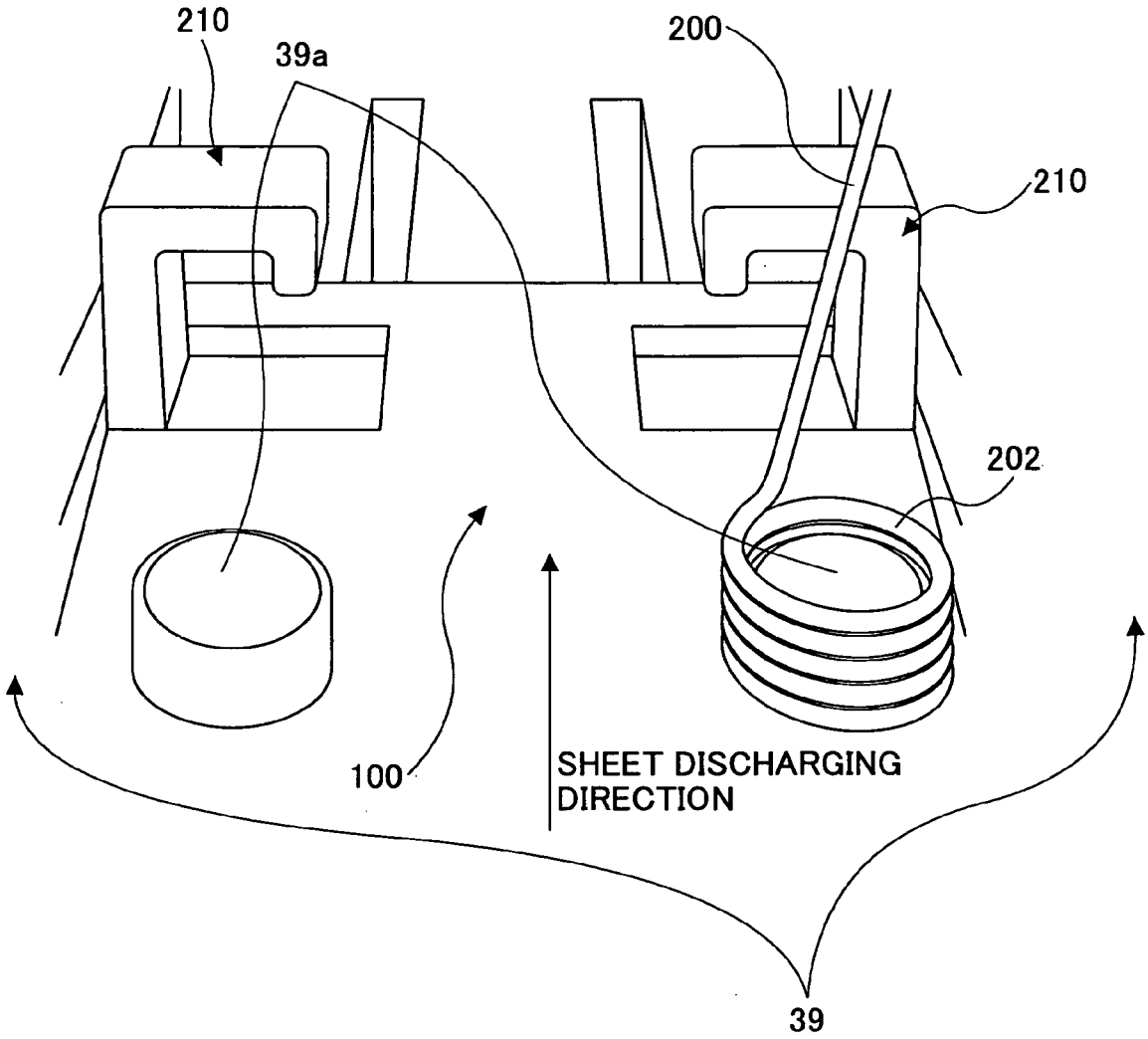
FIG. 5 is a diagram illustrating the third embodiment of the present invention.

FIG. 5 illustrates the third embodiment of the present invention. The present embodiment shown in FIG. 5 relates to the installation of the spring stoppers 200. Boss sections 39*a* for fixing the fitting coil portions 202 are formed in the depression 100 of the discharge stack unit 39, and the fitting coil portions 202 are fitted on the boss sections 39*a* so that the boss sections 39*a* engage the coil windings of the fitting coil portions 202. According to this structure, the number of required parts can be reduced, which results in a reduction in the cost. That is to say, the number of parts is reduced by integrally forming the boss sections 39*a*, to which the spring stoppers 200 are attached, with the discharge stack unit 39 functioning as a catch tray. Stopper catch portions 210 are also provided in the depression 100 of the discharge stack unit 39, and the spring stoppers 200 can be put away by catching the spring stoppers 200 with the stopper catch portions 210. Each stopper catch portion 210 has a substantially L-shaped configuration so as to catch the spring stopper 200 on the lower face, thereby preventing the spring stopper 200 from rising back. In addition, the stopper catch portions 210 are provided in such a manner as not to stick up from the upper surface of the discharge stack unit 39.

According to such a structure, the spring stoppers 200 can be bent in the sheet discharging direction and put away in the depression 100 when not used. Note that the parts to which the spring stoppers 200 are attached do not have to be integrally provided, and they may be provided by separate parts. This allows the boss sections 39*a* to be changed (for example, when maintenance is performed, or in the case where it is desired to select the boss section 39*a* having a diameter in accordance with the diameter of the coil portion 202).

Fourth Embodiment

Figure 6:
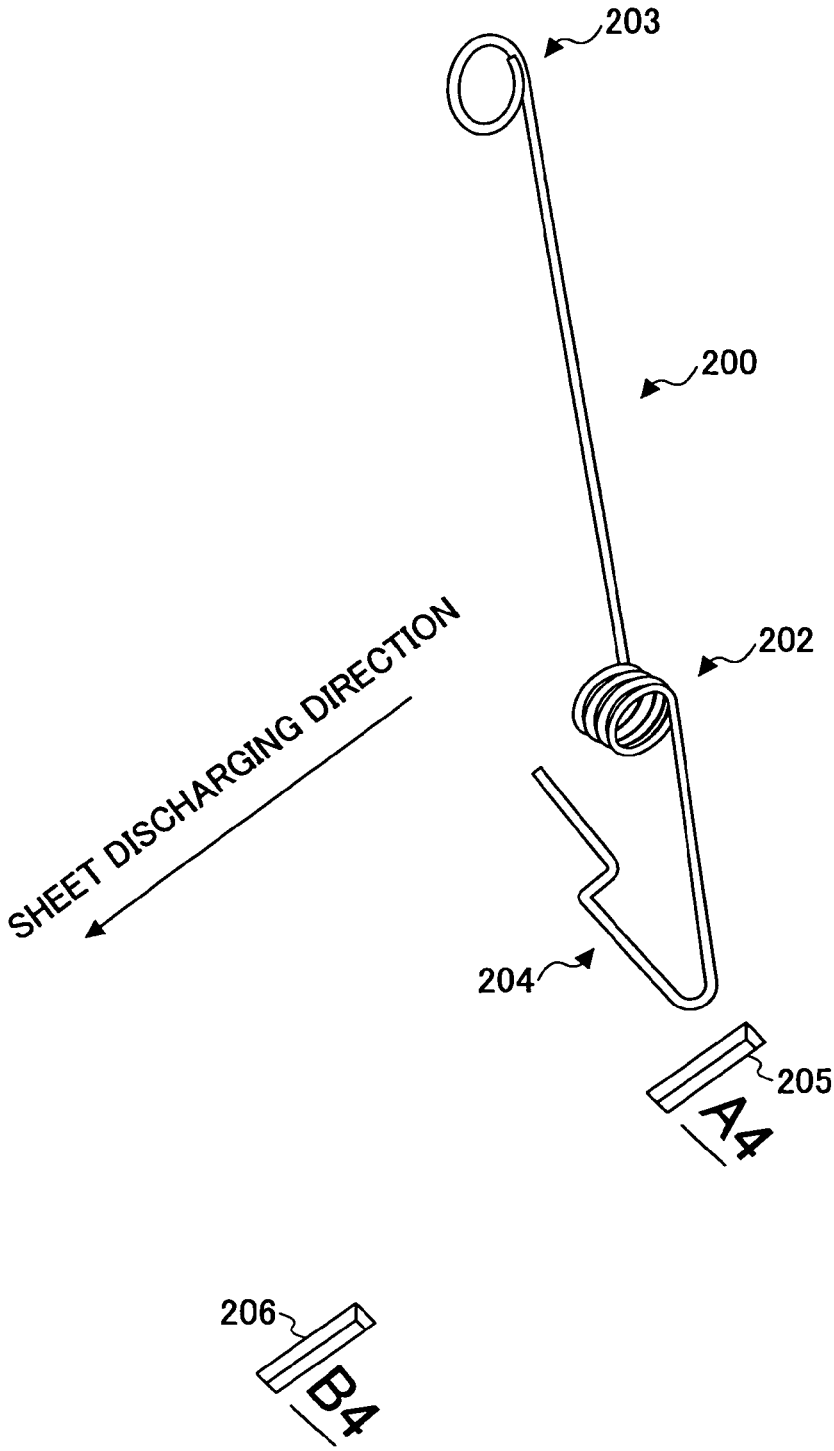
FIG. 6 is a diagram illustrating the fourth embodiment of the present invention.

FIG. 6 illustrates the fourth embodiment of the present invention. According to the present embodiment shown in FIG. 6, a part of the elastic spring stopper 200 which is fixed to the discharge stack unit 39 is an elastic snap-fitting portion 204 formed by extending the end portion of the mounting coil portion 202. On the discharge stack unit 39, slits 205 and 206 are provided at positions corresponding to sheet sizes. An indication representing a sheet size is provided near each slit 205 and 206. The spring stopper 200 is installed by inserting the snap-fitting portion 204 into the slit 205/206. In the example shown in FIG. 6, the slits 205 and 206 are provided at positions corresponding to A4 size and B4 size, respectively.

Herewith, by changing the position of the spring stopper 200 in accordance with a sheet size, it is possible to further improve the stack alignment. In addition, the user is able to readily identify the location for installing the spring stopper 200 since the sheet size is clearly indicated near each slit.

Fifth Embodiment

Figure 7:
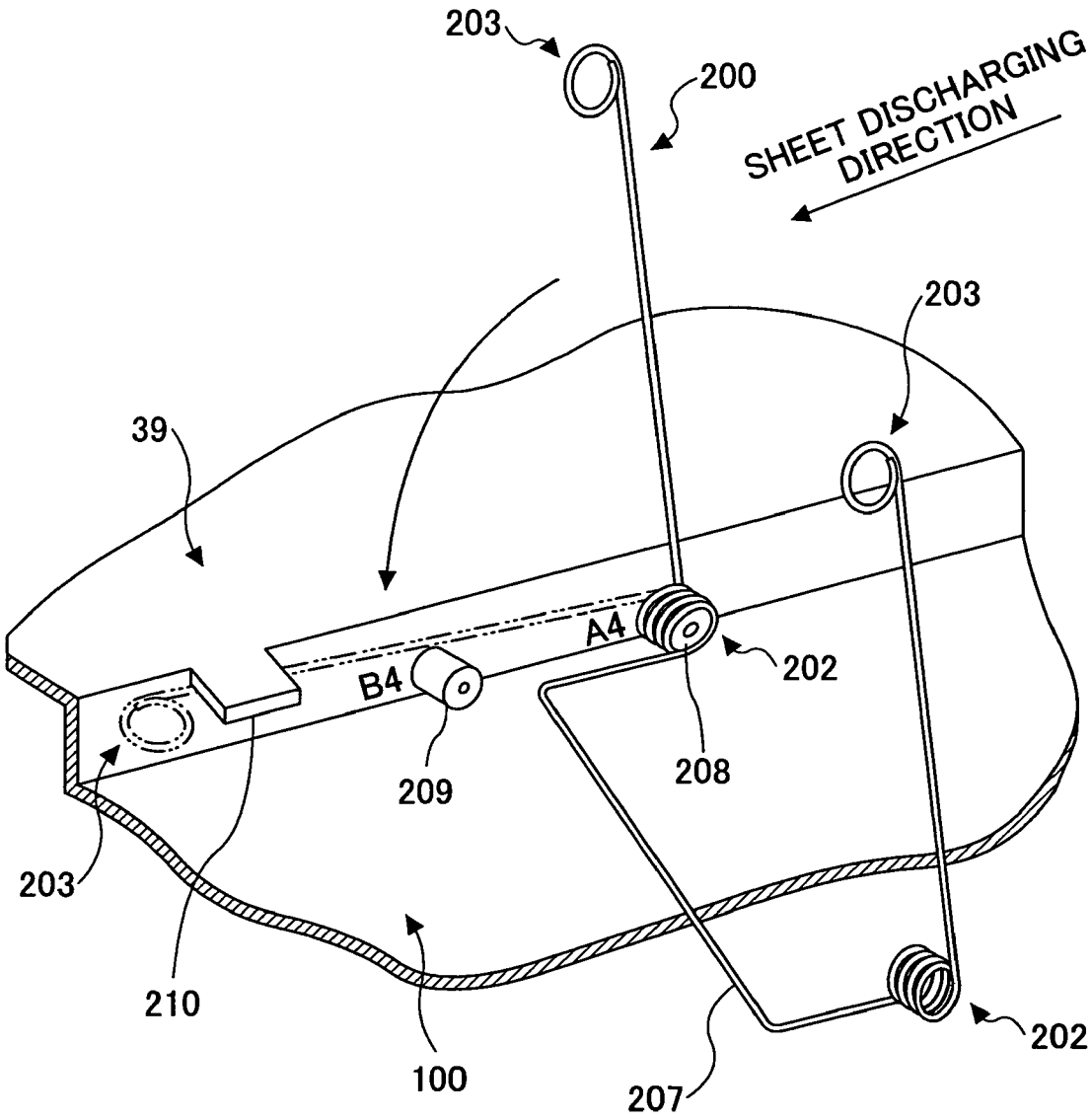
FIG. 7 is a diagram illustrating the fifth embodiment of the present invention.

Next is described the fifth embodiment of the present invention with reference to FIG. 7. The spring stopper 200 of the present embodiment has a structure in which two of the above-mentioned string stoppers 200 are integrated, and a coupling portion 207 in the shape of, for example, a semi-rectangle is provided by extending the fitting coil portions 202 on the rear anchor side. The spring stopper 200 of the present embodiment is formed of a single wire rod. On the lateral faces of the depression 100 of the discharge stack unit 39, boss sections 208 and 209 are provided to which the fitting coil portions 202 are attached. In addition, the stopper catch portions 210 (only one of them is shown in FIG. 7) are also provided on the lateral faces so as to catch arm portions of the spring stopper 200. Note that, as in the case of the fourth embodiment, indications corresponding to sheet sizes ("A4" and "B4" in this example) are provided near the boss sections 208 and 209.

According to the spring stopper 200 of the present embodiment, like the spring stopper 200 of the second embodiment of FIG. 4, the two arms of the spring stopper 200 stands up substantially parallel to the main scanning direction of the sheet S when used for the stack alignment. When the spring stopper 200 is not used, the tip portions are pushed down by rotating the spring stopper 200 around the boss sections 208 and 209, and put away by catching the arm portions of the spring stopper 200 with the stopper catch portions 210 (indicated by the broken line in FIG. 7). That is, since the spring stopper 200 is made of an elastic wire rod material, coils and loops (fitting coil portions 202 and tight loop portions 203) can be formed by simply bending and winding the tips of the wire rod. In addition, the coil portions allows the spring stopper 200 to be used on multiple bosses (boss sections 208 and 209) of the catch tray (discharge stack unit 39) by simply detaching the spring stopper 200 from one paired boss sections and attaching it to another. Thus, a single spring stopper 200 can deal with sheets of different sizes. Furthermore, since the spring stopper 200 made of a wire rod material is elastic, it is possible to deal with sheets of non-standard sizes by engaging the arm portions of the spring stopper 200 with the engaging portion (stopper catch portions 210) so that the spring stopper 200 is hidden below the sheet stacking surface of the discharge stack unit 39. This structure also allows the spring stopper 200 to accommodate the situation where the use of the spring stopper 200 is not desired, for example, when sheets of various sizes are stacked together on the discharge stack unit 39.

In the present embodiment, if the spring stopper 200 has been set for, for example, A4 landscape, the spring stopper needs to be removed or changed to a different position in order to discharge sheets whose length is greater than that of A4 landscape (e.g. B4). Note, however, that since A4 sheets in landscape orientation are used very often, it is preferable that the spring stopper 200 be usually set to a position corresponding to A4 landscape, and the position of the spring stopper 200 be changed in the case of using sheets whose length is greater than that of A4 landscape. Thus, the spring stopper 200 of the present embodiment, which is formed by integrating multiple sheet contact units (spring stoppers), has a structure allowing easy attachment and detachment and achieving good stack alignment performance.

Sixth Embodiment

Figure 8A:
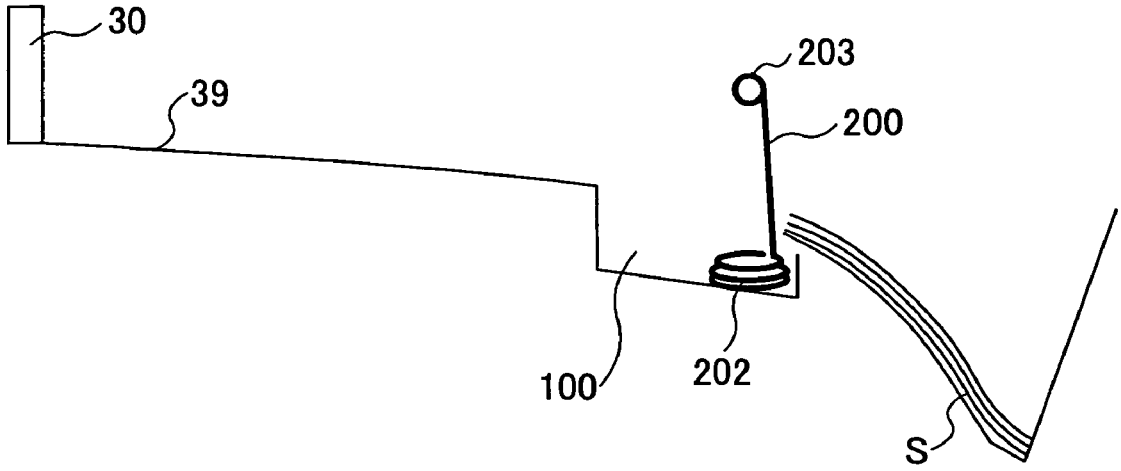
FIG. 8 is a diagram illustrating the sixth embodiment of the present invention.
Figure 8B:
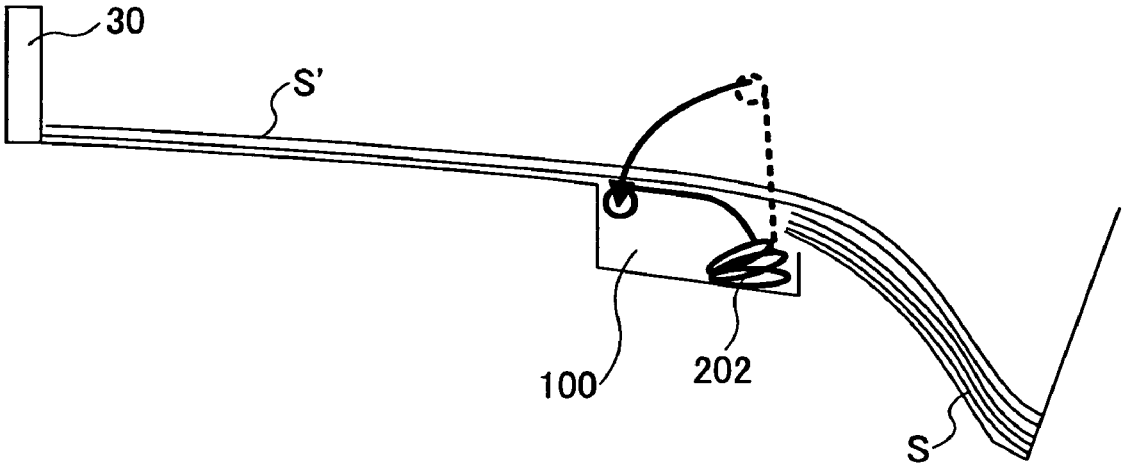

Next is described the sixth embodiment of the present invention with reference to FIGS. 8A and 8B. The present embodiment allows the stacking of sheets of different sizes by combining the spring stopper 200 and the end stopper 30 described in the first through fifth embodiments. Since the structure of the spring stopper 200 according to the present embodiment adopts those of the spring stoppers 200 described in the first through fifth embodiments, the description is omitted to avoid repetition.

FIG. 8A illustrates A4 sheets S being stacked, and FIG. 8B illustrates sheets S' of larger size (e.g. A3) being stacked over the A4 sheets S. In the case of A4 size, each sheet S after discharge directly slides down on the sloping surface provided in the discharge stack unit 39 on the upstream side, or hits the spring stopper 200 and then slides down on the sloping surface. Herewith, the edges of the sheets S are aligned. The spring stopper 200 is provided in such a manner that, even if a sheet S hits the spring stopper 200, the sheet S does not go over the spring stopper 200 and reach downstream of the discharging direction.

In the case of A3 size, when the leading edge (in the discharging direction) of a sheet S' hits the spring stopper 200, the elastic spring stopper 200 is overwhelmed by the conveyance force of the sheet S' and brought down in the discharging direction, as shown in FIG. 8B. Accordingly, the sheet S' passes over the bent spring stopper 200 and are then laid on the discharge stack unit 39.

In the present embodiment, the diameter of the wire rod of the spring stopper 200, the inclination angle θ and the elasticity of the spring stoppers 200 are designed such that the spring stoppers 200 are able to withstand the hitting impact of each A4 sheet S and align the sheets S while allowing A3 sheets S' to pass overhead and be then laid on the discharge stack unit 39.

Specifically, the spring stopper 200 is installed in such a manner that the boss section 39*a* of FIG. 5 does not fully pass through the mounting coil portion 202. More preferably, the spring stopper 200 is fit onto the boss section 39*a* only at the lower part of the coil portion 202. At this point, by changing the fitting amount of the coil portion 202 onto the boss section 39*a*, it is possible to adjust the degree of elastic deformation of the spring stopper 200 when hit by a sheet S'. According to this structure, when a sheet S' hits the spring stopper 200, the upper part of the spring stopper 200, which includes a part of the coil portion 202 not engaged with the boss section 39*a*, elastically bends toward the downstream side of the discharging direction, as shown in FIG. 8B. While in the first embodiment, the inclination angle θ of the spring stopper 200 is 75° in the reverse direction of the discharge of the sheets S, the inclination angle θ in the present embodiment is 135° in the reverse direction of the discharge of the sheets S so that the spring stopper 200 is readily brought down by the conveyance force of a sheet S'. Furthermore, the diameter of the wire rod of the spring stopper 200 is determined in such a manner that the spring stopper 200 is brought down by the hitting impact of a sheet S' but not brought down by the hitting impact of a sheet S. According to this structure, it is possible to deal with sheets of different sizes without removing the spring stopper 200.

Note that the spring stopper 200 of FIG. 6 or FIG. 7 may be used instead in the present embodiment. In this case, the direction in which the spring stopper 200 is brought down in relation to the winding direction of the coil portion 202 is different from that in the first embodiment. Therefore, the spring stopper 200 of FIG. 6 or FIG. 7 should be installed with consideration of the inclination angle θ, the diameter of the wire rod and the like according to the elasticity. Herewith, it is possible to achieve the same effects as described above.

Figure 9:
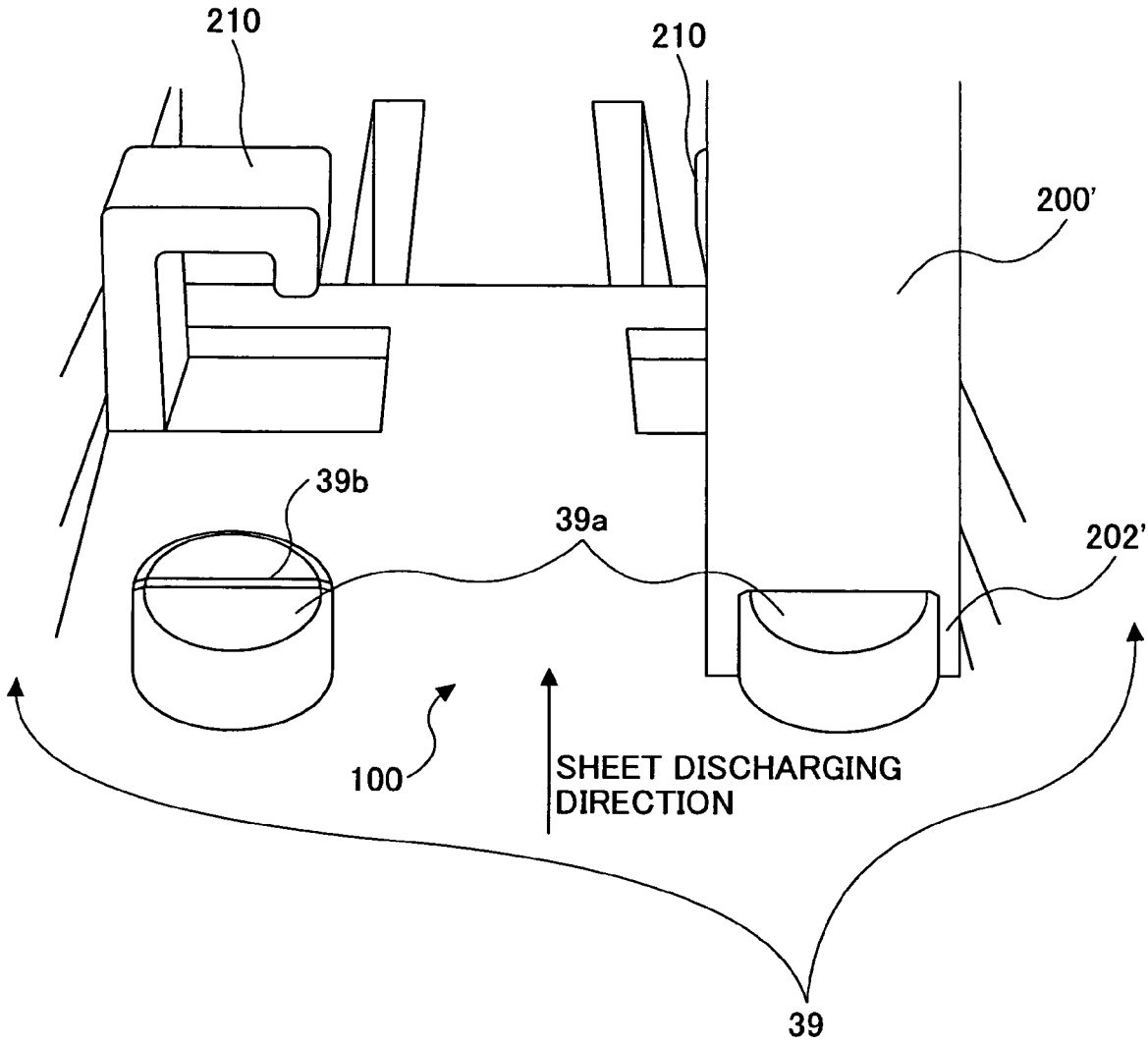
FIG. 9 is a diagram illustrating a modification of the sixth embodiment.

The spring stopper 200 may be made of an elastic material other than a wire rod. For example, FIG. 9 illustrates a plate-shaped elastic sheet 200' made of Mylar (registered trademark), for example. For purposes of facilitating the description, FIG. 9 illustrates the elastic sheet 200' provided only on the right-hand boss section 39*a*, as in the case of FIG. 5; however, the elastic sheet 200' is also provided on the left-hand boss section 39*a* in the same manner. Each elastic sheet 200' is inserted into a slit 39*b* on the boss section 39*a*. The thickness, the angle and the length (vertical direction in FIG. 9) of the elastic sheets 200' are designed such that the spring stoppers 200' are able to withstand the hitting impact of each A4 sheet S and align the sheets S while allowing A3 sheets S' to pass overhead and be then laid on the discharge stack unit 39. The slit 39*b* is provided in the direction perpendicular to the sheet discharge direction and extends to the bottom of the boss section 39*a*. Accordingly, each elastic sheet 200' is simply shaped into a rectangle and does not have to be shaped to conform to the shape of the slit 39*b*, thus allowing a simple structure. According to this structure, when a sheet S'hits the elastic sheets 200', the elastic sheets 200' elastically bend (are brought down) toward the downstream side of the discharging direction and allows the sheet S' to pass overhead and be then laid on the discharge stack unit 39. Hence, it is possible to deal with sheets of different sizes without removing the spring stoppers 200. Note that as in FIGS. 5 and 7, the elastic sheets 200' can be put away inside the depression 100 by bringing down the elastic sheets 200' toward the downstream side of the discharging direction and catching the elastic sheets 200' on the lower faces of the stopper catch portions 210.

Note that the above-described embodiments can be applied to catch trays of not only image forming apparatuses but also post-processing apparatuses having a punching function or a stapling function. Also, the members of the depression 100 (i.e. the boss sections 39*a*, boss sections 208 and 209, and stopper catch portions 210) may be unitized as a single assembly discrete from the catch tray so as to be detachable from the catch tray. According to this structure, the unitized assembly can be provided only for users seeking sheet size convertibility or requiring the stacking performance for sheets of different sizes.

As has been described above, according to a stack alignment device of an embodiment of the present invention, even if a preceding sheet is pushed out by a succeeding sheet sue to surface friction of these sheets, the preceding sheet is pushed back upstream in the sheet discharging direction by the elasticity of the stopper member. Hence, using such a simple and low-cost structure, it is possible to align a stack of sheets in the catch tray without a jam.

This application is based on Japanese Patent Applications No. 2008-031067 filed on Feb. 12, 2008 and No. 2008-260297 filed on Oct. 7, 2008, the contents of which are hereby incorporated herein by reference.

What is claimed is:

1. A catch tray for stacking thereon sheets discharged from an apparatus, the catch tray comprising:

a first sheet-stacking area disposed upstream of a sheet discharging direction and having a sloping surface extending upwardly from an upstream side to a downstream side of the sheet discharging direction;

a second sheet-stacking area extending from an end of the sloping surface on the downstream side;

a first stopper regulation part disposed, within the second sheet-stacking area, on the downstream side of the sheet discharging direction, and configured to regulate edges of the discharged sheets of a largest size allowed to be stacked on the catch tray; and a second stopper regulation part disposed in the first sheet-stacking area, and configured to regulate edges of the discharged sheets of a size smaller than the largest size and elastically deform in the sheet discharging direction when a sheet of the largest size is discharged so as to allow the first stopper regulation part to regulate an edge of the sheet of the largest size.

2. The catch tray as claimed in claim 1, further comprising:

a depression part disposed in the first sheet-stacking area; and an engaging part disposed in the depression part and configured to engage with the second stopper regulation part.

3. The catch tray as claimed in claim 2, wherein the second stopper regulation part is a plate-shaped elastic body.

4. The catch tray as claimed in claim 2, wherein the second stopper regulation part includes a first coil portion made of a wire rod wound at least one turn into a coil, and the engaging part includes a convex portion onto which the first coil portion is fixed.

5. The catch tray as claimed in claim 4, wherein the second stopper regulation part includes a second coil portion at an end opposite to the first coil portion.

6. The catch tray as claimed in claim 2, wherein the second stopper regulation part is a plate-shaped elastic body, and the engaging part includes a convex portion having a slit into which the second stopper regulation part is inserted.

7. The catch tray as claimed in claim 2, wherein the depression includes a holding part for catching and housing the second stopper regulation part.

8. The catch tray as claimed in claim 2, wherein the engaging part is integrally formed with the depression part.

9. The catch tray as claimed in claim 2, wherein a plurality of the engaging parts is disposed in the sheet discharging direction.

10. The catch tray as claimed in claim 1, wherein the second stopper regulation part includes a plurality of second stopper regulation parts that are disposed perpendicular to the sheet discharging direction.

11. The catch tray as claimed in claim 10, wherein each of the plurality of second stopper regulation parts includes a coil portion made of a wire rod wound at least one turn into a coil.

12. The catch tray as claimed in claim 10, wherein each of the plurality of second stopper regulation parts is a plate-shaped elastic body.

13. The catch tray as claimed in claim 1, wherein the second stopper regulation part includes a coil portion made of a wire rod wound at least one turn into a coil.

14. An image forming apparatus comprising a catch tray for stacking thereon sheets discharged from an apparatus, wherein the catch tray includes:

a first sheet-stacking area disposed upstream of a sheet discharging direction and having a sloping surface extending upwardly from an upstream side to a downstream side of the sheet discharging direction;

a second sheet-stacking area extending from an end of the sloping surface on the downstream side;

a first stopper regulation part disposed, within the second sheet-stacking area, on the downstream side of the sheet discharging direction, and configured to regulate edges of the discharged sheets of a largest size allowed to be stacked on the catch tray; and a second stopper regulation part disposed in the first sheet-stacking area, and configured to regulate edges of the discharged sheets of a size smaller than the largest size and elastically deform in the sheet discharging direction when a sheet of the largest size is discharged so as to allow the first stopper regulation part to regulate an edge of the sheet of the largest size.

* * * * *